United States Patent [19]

Derbyshire et al.

[11] 4,334,977

[45] Jun. 15, 1982

[54] METHOD FOR THE GENERATION OF RECYCLE SOLVENTS IN COAL LIQUEFACTION

[75] Inventors: Francis J. Derbyshire, Ewing; Philip Varghese, Trenton; Darrell D. Whitehurst, Titusville, all of N.J.

[73] Assignee: Mobil Oil Corporation, New York, N.Y.

[21] Appl. No.: 225,283

[22] Filed: Jan. 15, 1981

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,018,241 | 1/1962 | Gorin | 208/8 LE |
| 3,232,861 | 2/1966 | Gorin et al. | 208/10 |
| 3,523,886 | 8/1970 | Gorin et al. | 208/8 LE |
| 3,583,900 | 6/1971 | Gatsis | 208/8 LE |
| 4,022,680 | 5/1977 | Maa | 208/8 LE |
| 4,032,428 | 6/1977 | Johnson | 208/8 LE |
| 4,048,054 | 9/1977 | Preen et al. | 208/8 LE |
| 4,049,536 | 9/1977 | Plumlee et al. | 208/8 LE X |
| 4,049,537 | 9/1977 | Plumlee et al. | 208/8 LE |
| 4,051,012 | 9/1977 | Plumlee et al. | 208/8 LE |
| 4,082,644 | 4/1978 | Gatses et al. | 208/8 LE |
| 4,094,766 | 6/1978 | Gorin | 208/8 LE X |
| 4,123,347 | 10/1978 | Maa | 208/8 LE |
| 4,133,646 | 1/1979 | Farcasin et al. | 208/8 LE |
| 4,148,709 | 4/1979 | Sze | 208/8 LE |

FOREIGN PATENT DOCUMENTS

| | | | |
|---|---|---|---|
| 53-51204 | 5/1978 | Japan | 208/8 LE |

*Primary Examiner*—Delbert E. Gantz
*Assistant Examiner*—William G. Wright
*Attorney, Agent, or Firm*—Charles A. Huggett; Michael G. Gilman; Charles J. Speciale

[57] ABSTRACT

A method is described to improve a coal liquefaction process by the use of a recycle solvent comprised of two fractions: the first, a lower boiling fraction, is obtained by an atmospheric distillation and is subsequently hydrotreated to enrich its hydrogen donor capacity; the second is a higher boiling fraction that is enriched in desirable hydrogen transfer agents by a solvent extraction process. The combined recycle solvent thus obtained is more efficient in transferring gas phase $H_2$ to the coal and enables other significant process improvements.

5 Claims, 5 Drawing Figures

CONVERSION OF BELLE AYR COAL IN DONOR-NON-DONOR SOLVENT MIXTURES (400° C, 1 HR, 1000 PSIG)

CONVERSION OF MONTEREY COAL IN DONOR-NON-DONOR SOLVENT MIXTURES (400° C, 1 HR., 1000 PSIG)

EFFECT OF $H_2$ PRESSURE ON COAL CONVERSION IN DONOR-NON-DONOR SOLVENT MIXTURES (400°C, 1 HR.)

EFFECT OF SOLVENT AND GAS ATMOSPHERE ON HYDROGEN TRANSFER
(400° C, 1HR, 1000 PSIG)

METHOD FOR THE GENERATION OF RECYCLE SOLVENTS IN COAL LIQUEFACTION

BACKGROUND OF THE INVENTION

1. Field of the Invention

This invention relates to the liquefaction of coal or similar liquefiable carbonaceous solids and is particularly concerned with H-donor solvent liquefaction processes in which recycle solvents are recovered from liquids produced by the treatment of carbonaceous solids with molecular H and a donor solvent. The principal object of such direct coal liquefaction processes, sometimes referred to as solvent refined coal processes, is to stabilize molecular fragments generated by thermal degradable coal. This is achieved by "capping" the coal-derived free radicals with hydrogen. It requires the hydrogen be provided at a rate and in a form compatible with the demand established by the thermal reaction of the coal. Although the alternate source of $H_2$ is hydrogen gas, the most efficient route for hydrogen transfer is by way of the liquefaction solvent. Hydrogen is supplied most readily from hydrogen donor compounds which may be process-derived and replenished by catalytic hydrogenation either within the liquefaction zone or in a separate zone.

2. Description of the Prior Art

Conventional schemes for the liquefaction of coal via solvent refining involve recycling a process-derived solvent boiling in the range from about 400°–850° F. to the coal dissolver. For example, U.S. Pat. No. 3,232,861 suggests hydrogenation of a deashed coal extract and recovering recycle solvent from the hydrogenated extract. Also see U.S. Pat. No. 3,523,886. Schemes wherein solvent boiling range material is separated from liquefaction zone effluent and is either hydrogenated in a separate catalytic solvent hydrogenation zone or returned directly to the liquefaction zone to be hydrogenated "in situ" have also been proposed. See U.S. Pat. Nos. 4,022,680; 4,049,536; 4,049,537; 4,051,012; and 4,123,347. U.S. Pat. No. 4,048,054 teaches a process wherein liquids obtained from vacuum atmospheric distillation and boiling in the range from 250° to 850° or 1000° F. are hydrogenated in one solvent hydrogenation unit. Heavier recycle solvent materials boiling in the range from 700°–1000° F. are recovered by vacuum distillation. Hydrogenation of solvent materials may be catalyzed either by commercial hydroconversion catalysts or by the mineral matter in accumulated, liquefaction-reactor solids.

Copending U.S. Patent Application Ser. No. 055,948, filed July 9, 1979, now abandoned discloses novel solvent materials which are capable of being thermally hydrogenated in the absence of hydrogenation catalysts and also have the ability of being dehydrogenated or of donating hydrogen atoms to free radicals resulting from the depolymerization of constituents in solid carbonaceous material. These solvent materials are described as polycyclic hydrogen transfer solvents having polarographic potentials less negative than phenanthrene but equal to or more negative than azapyrene. Exemplary of such materials are pyrene, fluoranthene, anthracene, benzanthracene, dibenzanthracene, perylene, coronene, their heteronitrogen analogs, quinoline, and lower alkyl analogs of the foregoing. To be distinguished from the hydrogen transfer solvents are the hydrogen donor solvents of conventional processes, e.g., tetraline, alkyl-substituted tetraline, naphthalene, etc. Although the hydrogen transfer solvent may be mixed with o other materials such as hydrogen donor solvents, the process taught excludes contact of a separated recycle solvent fraction with heterogenous hydrogenation catalysts.

Copending U.S. Patent Application Ser. No. 107,817, filed Dec. 28, 1979 now U.S. Pat. No. 4,292,164, discloses a process for recovering hydrogen transfer solvents from a coal liquefaction product. Briefly, this application teaches removal of light hydrocarbon components boiling below 200° C. from the coal liquefaction zone product and extraction of the heavier liquid with a process-derived naphtha having an aromatic content of 20 wt.% or less. The fraction of the heavier coal liquid which is soluble in the naphtha is recovered for recycle to the liquefaction zone as the hydrogen transfer solvent. Again, the process disclosed excludes a separate catalytic hydrogenation zone and relies on in situ hydrogenation/dehydrogenation of the hydrogen transfer solvent to liquefy solid carbonaceous feed.

A problem which has caused substantial difficulty in developing an economical operation for solvent extracting coal has been the inability to facilitate the transfer of sufficient hydrogen into the hydrogen-deficient coal during the extraction step. Hydrogen donor solvents have provided a partial solution to this problem. However, the amount of hydrogen which hydrogen donor solvents can typically transfer into the coal is quite limited, and, as noted above, a further hydrogenation treatment subsequent to the extraction operation is generally necessary when using them to extract the coal. The discovery of hydrogen transfer solvents and their facility for thermal hydrogenation is an important one, but enhanced hydrogen transfer during coal liquefaction is still desirable.

Accordingly, a primary object of the present invention is an improved, process-derived recycle solvent. A related object is an improved method for the recovery and treatment of recycle solvents from the products of coal liquefaction. A further related object is an improved method for the liquefaction of carbonaceous material.

Other objects and advantages of the present invention will become apparent from the accompanying description and examples.

SUMMARY OF THE INVENTION

The improved coal liquefaction process of the present invention is based on the discovery that mixtures of hydrogen transfer solvents and conventional hydrogen donor solvents have an unexpectedly high capacity for hydrogen transfer and are synergistic in coal conversion. More particularly, it has been discovered that when hydrogen transfer solvents such as the polynuclear aromatics pyrene, fluoranthene and coronene are used in the presence of hydrogenated lower boiling classical donor solvents such as tetralin, 9–10 dihydrophenanthrene, etc., these hydrogen transfer agents are more efficient, allowing a greater fraction of the net hydrogen demand in liquefaction to be met by gas phase molecular hydrogen. This synergism is employed in the modified liquefaction process of the present invention to produce overall process improvement.

Recycle solvent is recovered from a converted mixture of solid carbonaceous material and recycle solvent by first distilling said mixture under substantially atmospheric pressure to recover the following fractions: a light fraction comprising gases and light liquids boiling below 250° F. to 400° F., a middle distillate fraction boiling below 600° to 700° F. and a heavy bottoms fraction. Recycle hydrogen donor solvent is produced by catalytically hydrotreating at least a portion of the middle distillate fraction according to the manner well known in the art for hydrogen donor solvent rehydrogenation. Recycle hydrogen transfer solvent is produced by extracting the heavy bottoms fraction with a naphtha containing from 10 to 50% aromatics and separating from the naphtha the components soluble therein as a recycle hydrogen transfer solvent.

The recycle solvent contains 5 to 70% hydrogenated solvent range material (hydrogen donor solvent), the remainder being solvent extracted material (hydrogen transfer solvent).

An essential element of this invention is that the portion of the middle distillate to be returned to the liquefaction zone as recycle hydrogen donor solvent be hydrogenated in a separate catalytic reactor. External solvent rehydrogenation is not unknown in the practice of coal liquefaction. A primary distinction of the present process is that only a portion, or fraction, of the total recycle solvent is hydrogenated. Furthermore, a flexible solvent extraction step is employed to select optimal compositions of nonhydrogenated, higher boiling solvent range material for recycle. Selective hydrogenation of low boiling solvent range material has been suggested previously. However, use of such schemes has been in the context of more complex multi-stage liquefaction processes or have involved merely intermittent hydrogenation of low boiling solvent range material. Such processes do not attain the desirable results of the present invention.

A primary improvement of the present process is that it exploits a previously unknown and beneficial synergism between conventional hydrogenated donor solvents and higher boiling hydrogen transfer agents in transferring molecular hydrogen to the coal. Further process improvements result from the fact that atmospheric distillation will suffice to isolate the lower boiling fraction of solvent range materials that are fed to the hydrotreater. Moreover, hydrotreater operation is eased by the reduced hydrogenation required of it and yet, in spite of the reduced hydrotreater load, high levels of coal conversion are maintained in the liquefaction zone; hydrotreater operating economies result from a greater amount of the net hydrogen demand being met by molecular hydrogen added to the liquefaction zone. Further process economies are affected with respect to hydrotreater operability; catalyst life and performance are significantly improved due to the lower boiling range and metals content of the feed. Therefore, the need for special catalysts and/or severe hydrotreating conditions is obviated. A further advantage of the present process is an improvement in product quality due to the enhanced solvent quality resulting from minimized depletion of hydroaromatic donors.

DETAILED DESCRIPTION OF THE INVENTION

The term "solid carbonaceous material" includes any carbonaceous material containing less than about 88% carbon. The term includes materials such as anthracite coal, bituminous coal, subbituminous coal, lignite and peat. It further includes carbonaceous materials which contain substantial amounts of organic oxygen and pyritic and organic sulfur, but is not limited to such and includes, for example, materials having a low pyritic iron content.

A solid carbonaceous material which is subjected to the liquefaction process is in comminuted form. Ball mills or other kinds of conventional apparatus can be employed for comminution. Comminution can be accomplished in either a dry state or in the presence of a liquid such as the solvent used in the practice of the invention. The average particle size of the solid carbonaceous material is not highly critical and can be selected mainly for ease of handling and pumping. In general, the particle size is 100 mesh or smaller.

Process conditions can vary widely based on the nature of the carbonaceous material, solvent and other factors.

Generally, the process of this invention is conducted at a temperature in the range of 320° C. to 500° C. The temperature selected is sufficient to depolymerize the constituents in the solid carbonaceous material, but not so high as to be excessive. Temperatures in the range of 350° C. to 450° C. have been found to be particularly suitable.

The pressure utilized in the process can also be varied within wide limits sufficient to achieve the degree of conversion desired. For example, the pressure can range from 200 to 4000 psig. More often, the pressure selected is in the range of 1500–3000 psig.

Residence time depends greatly on the components in the reaction, time and temperature. In general, the residence time ranges from 1 to 240 minutes. Preferably, conditions and components are selected so that the residence time is 5 to 90 minutes.

The process of this invention results in high conversions of the solid carbonaceous material to components which are solvent soluble. For example, conversions of at least about 60% are desired and conversions of 90% or more have been achieved. Conversion is measured by determining the percent of the product of the reaction which is soluble in tetrahydrofuran (THF). This method for determining conversion involves refluxing the product for approximately 17–24 hours (overnight) in a Soxhlet apparatus and determining the percent by weight of the product of reaction which has been extracted with THF.

Figure 1:
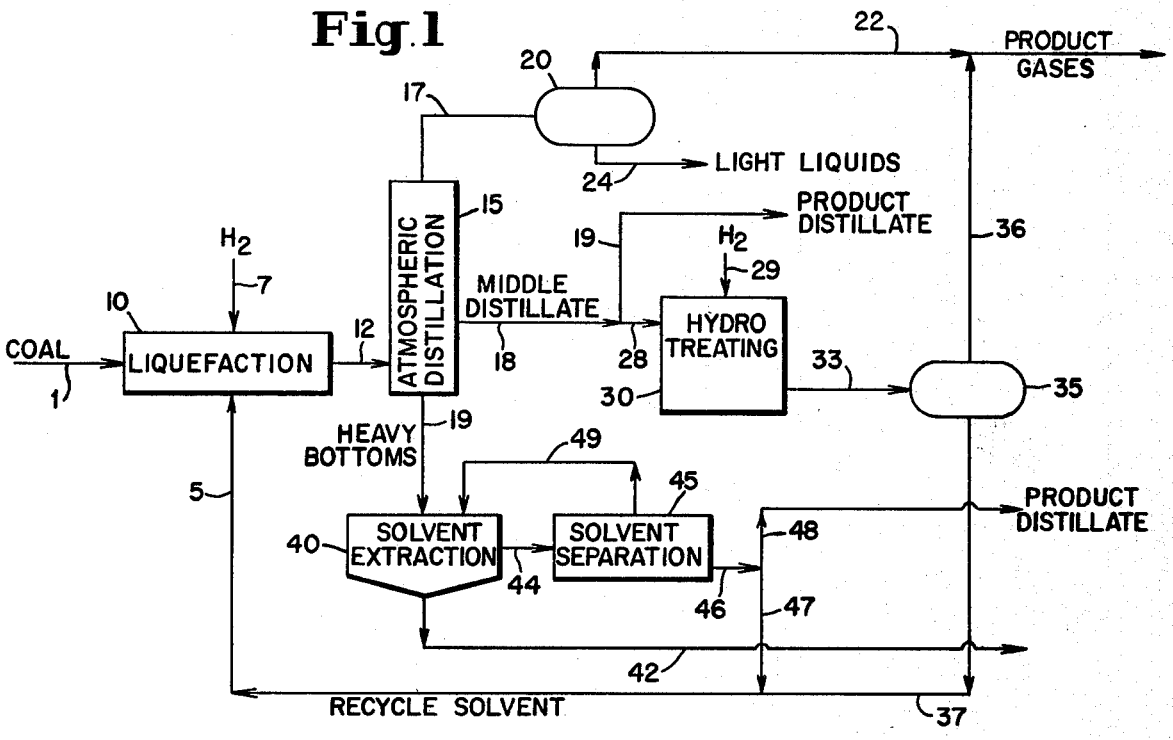
FIG. 1 is a schematic flow diagram of a specific embodiment of the process of this invention.

Referring now to FIG. 1, a preferred embodiment of the process of the present invention will be described. In the liquefaction zone 10, solid carbonaceous material introduced via line 1 and recycle solvent from line 5 are mixed to form a slurry which is heated and maintained in the presence of hydrogen introduced via line 7 at liquefaction temperature and pressure for a sufficient time to obtain at least about 60% conversion of the solid carbonaceous feed. The resulting digest is then distilled at substantially atmospheric pressure in zone 15 to recover a light fraction 17 comprising gases and light liquids boiling below about 250° to 400° F., a middle distillate fraction 18 boiling below about 600° to 700° F., and a heavy bottoms fraction 19.

The light fraction 17 is separated by conventional means such as a cold separator 20 to recover product gases 22 and light liquids 24.

Part of the middle distillate fraction 18 having boiling range from about 250°-400° F. to 600°-700° F. passes through line 28 to zone 30 where it is subjected to conventional hydrotreating under mild conditions over a commercial catalyst. The remainder of the middle distillate is recovered through line 19 as product distillate.

The conditions maintained in zone 30 include temperatures which normally range from about 650° F. to about 850° F., preferably from about 700° F. to about 800° F., and pressures which suitably range from about 650 psia to about 2000 psia, preferably from about 1000 psia to about 1500 psia. The hydrogen treat rate ranges generally from about 600 to about 10,000 SCF/B, preferably from about 1000 to about 5000 SCF/B. Hydrotreater operation is conventional: it is operated under conditions optimized for the production of hydrogen donors, those conditions being known to one skilled in the art.

The hydrogenation catalysts employed are conventional. Typically, such catalysts comprise an alumina or silica-alumina support carrying one or more Group VIII non-noble, or iron group metals, and one or more Group VI-B metals of the Periodic Table. In particular, combinations of one or more Group VI-B metal oxides or sulfides with one or more Group VIII metal oxides or sulfides are preferred. Typical catalyst metal combinations include oxides and/or sulfides or cobalt-molybdenum, nickel-molybdenum, nickel-tungsten, nickel-molybdenum-tungsten, cobalt-nickel-molybdenum and the like. A suitable cobalt molybdenum catalyst is one comprising from about 1 to about 10 weight percent cobalt oxide and from about 5 to about 40 weight percent molybdenum oxide, especially about 2 to 5 weight percent cobalt and about 10 to 30 weight percent molybdenum. Methods for the preparation of these catalysts are well known in the art. The active metals can be added to the support or carrier, typically alumina, by impregnation from aqueous solutions followed by drying and calcining to activate the composition. Suitable carriers include, for example, activated alumina, activated alumina-silica, zirconia, titania, etc., and mixtures thereof. Activated clays, such as bauxite, bentonite and montmorillonite, can also be employed.

Referring again to FIG. 1, hydrogen is introduced to hydrotreating zone 30 via line 29 and hydrotreated middle distillate withdrawn through line 33 to separation zone 35, e.g., a cold separator, to recover product gases 36 and hydrotreated liquids recovered through line 37 for return to liquefaction zone 10 as the hydrogen donor solvent component of the recycle solvent of the present invention.

The bottoms fraction 19 from zone 15 contains high boiling coal conversion products, uncoverted residues and ash. It is extracted in zone 40 with a solvent that is either process derived or of external origin so as to reject an insoluble precipitate comprising ash, unconverted solids and a highly polar fraction of the converted coal. Suitable extraction solvents include process derived naphthas having an aromatic content of 10 to 50 weight percent and boiling ranges of about 75° to 120° C. The lower end of the boiling range may vary broadly from 30°-100° C., preferably from 50°-90° C. The upper end of the boiling range may vary broadly from 100°-200° C., preferably from 115°-150° C.

Examples of suitable naphtha extraction solvents are crude untreated petroleum naphtha, coker naphtha from the pyrolyis of tar sands, cracked naphthas (e.g., cracked petroleum naphthas produced in FCC operations) and hydrotreated naphthas. Moreover, a suitable naphtha extraction solvent may be obtained by blending paraffins, naphthenes, olefins, and aromatics. The necessary qualities of the solvent are that it have a boiling range and aromatics content meeting the above-described criteria.

Primary operating variables of the present process are: (1) the nature of the coal being liquefied, (2) the extent to which that coal is converted (or liquefied) in the initial liquefaction step, (3) the extent to which materials are extracted from the heavy bottoms fraction in the naphtha solvent extraction step, and (4) the concentration of hydrogenated donor solvent agents in the recycle solvent. It will be understood that the only completely independent variable in the foregoing list is the nature of the coal being liquefied. All of the others are highly interrelated. For example, the depth of coal liquefaction (item 2) is dependent on the convertibility of the coal, the solvent properties, and the operating conditions (temperature, hydrogen pressure, etc.) of the liquefaction step. The solvent properties are in turn dependent on the depth of naphtha solvent extraction (item 3, i.e., the composition of the extracted materials), the concentration of hydrogenated donor solvent agents in the recycle solvent (item 4) and indeed on the nature of the coal itself (item 1).

Because of the interdependence of these operating variables, consideration must be given to more general objectives when designing specific applications of the process of this invention. The quality of coal liquids obtainable from any given coal feed may be ascertained empirically as may the hydrogen demand encountered for different levels of coal conversion (depths of liquefaction). In the process of the present invention, hydrogen demand (in the liquefaction zone) is also dependent on the depth of the naphtha solvent extraction. Typically, most of the hydrogen transfer agents present in the bottoms fraction from the distillation zone may be recovered by employing a naphtha solvent containing about 10 wt.% aromatics. To the extent that the aromatics content of the naphtha solvent exceeds this limit, progressively more non-hydrogen transfer material will be recovered in the recycle hydrogen transfer solvent stream. In other words, the aromatics content of the naphtha is chosen to vary the depth of the extraction: the greater the aromatics content, the greater the quantity of extracted material.

The depth of the naphtha solvent extraction is not narrowly critical but will be a function of the coal liquids produced in the liquefaction zone. An object of the naphtha solvent extraction step of the present invention is to reject phenolic and heteroatomic materials from the subsequently recycled stream which components interfere with hydrogen transfer in the liquefaction zone, either directly or by entering into unrelated, condensation reactions. Unlike the process disclosed in copending U.S. Patent Application Ser. No. 107,817, the naphtha solvent extraction step of the present invention is not limited to the recovery of higher quality hydrogen transfer agents from the coal liquefaction effluent. Rather, the recycle stream may contain materials in the higher boiling fraction of the coal liquefaction effluent which are not hydrogen transfer agents but which may advantageously be subjected to further conversion in the initial liquefaction step. This further conversion is enabled in the present process by the highly efficient hydrogen-transfer/donation qualities of the recycle solvent which qualities result from the co-action of the hydrogenated donor solvent component and the transfer solvent component. This co-action of solvent components is a highly effective means for balancing the hydrogenation capabilities of the liquefaction zone against hydrogen demand of the conversion occuring in that zone. Accordingly, it will be understood that the aromatics content of the naphtha extraction solvent is inversely related to the concentration of polyfunctional material (i.e., phenols and heteroatomic materials) in the coal liquid.

Precipitate from the solvent extraction zone 40 is withdrawn through line 42. The naphtha extraction solvent and the naphtha-soluble portion of the heavy bottoms fraction passes through line 44 to solvent separation zone 45 where the fraction of the coal liquid which is soluble in the naphtha is separated by means such as distillation for recycle as the hydrogen transfer solvent component 47 of the recycle liquefaction solvent of this invention. A portion of the naphtha soluble fraction may be withdrawn as product distillate 48. In a preferred embodiment of the present invention, the naphtha extract is distilled in zone 45 to obtain for recycle to liquefaction zone 10 that portion being above 230° C. Naphtha recovered in solvent separation zone 45 is returned via line 49 to solvent extraction zone 40.

The extraction can be carried out in zone 40 in conventional manner or under supercritical conditions. The weight ratio of naphtha solvent to bottoms fraction 19 is not narrowly critical, but may range from about 1 to 20, preferably from about 3 to 10. As stated above, materials from the atmospheric bottoms fraction 19 that are dissolved in the naphtha solvent will include hydrogen transfer agents such as pyrene. After the naphtha, extraction solvent is removed from the extractor overflow 44 by evaporation, a portion of the extracted material 47 is mixed with the hydrogenated solvent range material passing through line 37 to form the recycle solvent stream 5 returned to liquefaction zone 10.

The combined recycle solvent stream 5 may contain 5 to 70%, preferably 15–50%, of the hydrogenated solvent material. The ratio of solvent components comprising the recycle stream 5 is determined by factors discussed above in connection with the naphtha solvent extraction step. The examples discussed below (see especially FIGS. 2 and 3) demonstrate that the concentration of hydrogenated donor solvent agents should exceed about 5 to 20 wt.% of the hydrogen transfer solvent agents present in recycle solvent stream 5 to attain maximum benefit from the process of this invention. Higher concentrations of the donor solvent agents do not contribute significantly to the hydrogenation capability of the solvent of the present invention. Furthermore, the quantity of hydrogenated solvent material in recycle solvent stream 5 is determined by the physical properties of combined stream 5, for example, its viscosity and the need to avoid phase separation.

Recycle solvent stream 5 is provided in a quantity which is between about 0.5 to 10 parts by weight per part by weight of the comminuted coal being solubilized. Normally, the preferred range will be between about 1 to 3 parts by weight solvent per part by weight of coal.

The foregoing is a preferred embodiment of the process of this invention. However, it will be understood that certain modifications to this embodiment are possible which are within the scope of this invention. For example, the effluent stream from liquefaction zone 10 may be subjected to a physical, solids/liquid separation step before being introduced to atmospheric distillation zone 15. Such a separation will have the purpose of removing undissolved residue from the liquefaction product and may be accomplished by means such as centrifugation or filtration.

Products from the process embodiment described consist of the following: (a) gases and light liquids from the coal liquefaction and hydrotreating units, (b) distillate range material, and (c) underflow of precipitate from the solvent extraction unit. Further disposition or treatment of these product streams will be apparent to those skilled in the art. For example, in keeping with conventional practice, $H_2$ present in the product gases may be recycled for use in liquefaction or hydrotreating. Lighter materials are also useful as fuel. The underflow from the solvent extraction zone may be processed in a number of ways such as by gasification or coking, all of which are known in the prior art.

EXAMPLES

Experiments were conducted with bituminous (Monterey) and sub-bituminous (Belle Ayr) coals. The coals were prepared from 1–2" diameter lumps which had been stored under an argon atmosphere (without drying) in a refrigerated room since sampled from the mine. The lumps were crushed and sieved to minus 100 mesh in a glove bag under flowing argon. When sufficient sample had been ground, it was thoroughly mixed and then sealed in small vials, still under argon. A different vial was used for each experiment, the required quantity of coal being weighed from a newly opened vial and the remainder discarded. Analyses of the prepared coals are shown in Table I.

TABLE I

| Properties of Coals | Belle Ayr | Monterey |
|---|---|---|
| Elemental Analysis (m.f.) | | |
| % C | 72.20 | 75.18 |
| H | 5.65 | 5.82 |
| O | 20.56 | 12.78 |
| N | 1.19 | 1.38 |
| S | 0.40 | 4.84 |
| Ash | 4.50 | 11.19 |
| Sulphur Forms | | |
| Pyritic | 0.03 | 0.68 |
| Sulphate | 0.03 | 0.75 |
| Organic | 0.35 | 2.97 |
| Total | 0.41 | 4.40 |

The conversions were carried out in a small stirred autoclave, a reactor of about 12 cc. capacity heated by a close fitting electric furnace. Agitation was provided through the movement of an oscillating plunger which is driven by an electromagnet. A relatively large free volume above the reactor was kept cold, acting as a gas reservoir and allowing operation under virtually isobaric conditions.

The reactor was loaded with a mixture of solvent and coal in the ratio of 3.1 on a dry coal basis. After pressurizing the reactor, the system was heated to the desired temperature with agitation. The time required to reach reaction temperature was an additional 30 minutes. Reproducibility of temperature profiles was good as were the calculated conversions. Several sets of repeated experiments showed a variation of less that ±3% in conversion.

At the end of the reaction, a quantity of tetrahydrofuran (THF) was injected into the reactor while still under pressure following which it was quenched using an ice/water bath. The objective of injecting THF was to facilitate the removal of the solid reaction products.

After venting, the reactor contents were removed in more THF and transferred to a Soxhlet extraction apparatus where they were continuously extracted in THF for 18–24 hours under argon. Conversions were calculated on the basis of the insoluble residue.

Figure 2:
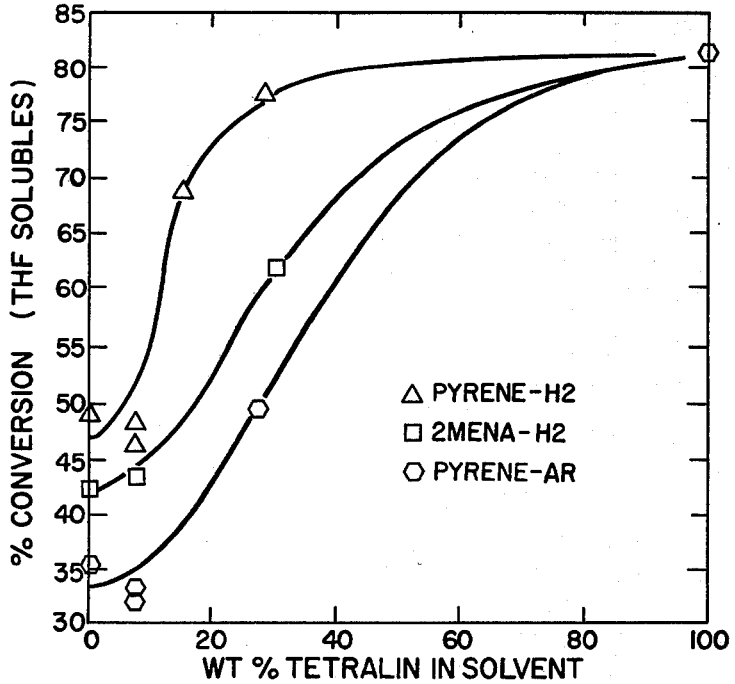
FIGS. 2–3 describe conversions of coal in various model solvent mixtures.
Figure 3:
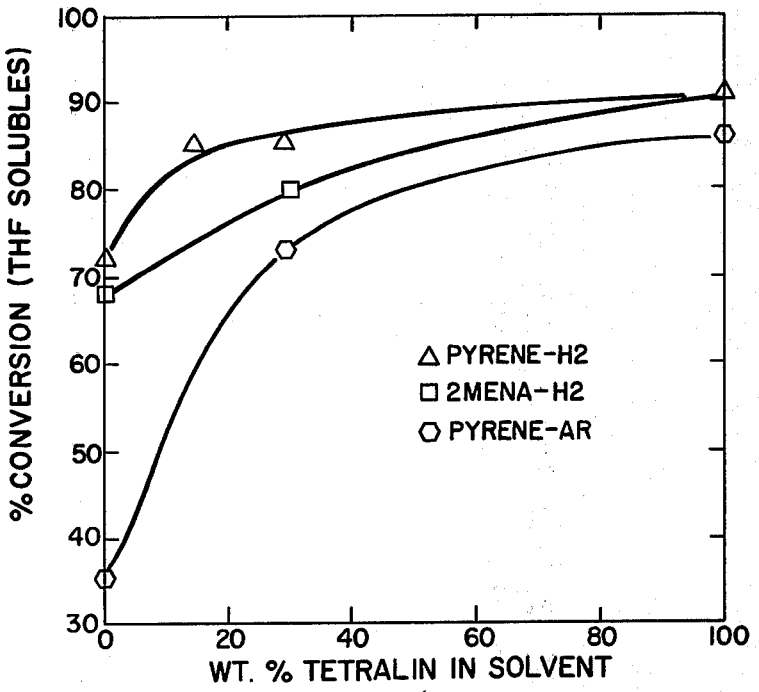

Conversion to THF soluble products and gases is shown as a function of tetralin concentration for Belle Ayr and Monterey coals in FIGS. 2 and 3 respectively. The reactions were carried out at 400° C. for 1 hour under 1000 psig gas pressure. On the two figures, data are presented showing conversions in pyrene-tetralin mixtures both in argon and in hydrogen and, for comparison, in 2-methyl naphthalene-tetralin mixtures in the presence of hydrogen.

For both coals, the conversion in the absence of a donor was enhanced by the presence of gaseous hydrogen. As expected, the conversion obtained in pyrene is higher than in a less condensed compound such as 2-methyl naphthalene and its effectiveness as a solvent is related to the formation of dihydropyrene during liquefaction.

With reference to FIG. 2, the effect of adding tetralin up to about 8 wt% appeared to have little effect on conversion in the three systems shown. Further increase in the donor concentration was accompanied by increasing conversion which reached a limiting value of about 85% at tetralin concentrations of about 70% and above. At the high donor levels, the conversion was not apparently affected by the nature of the other component or by the gas atmosphere.

The major differences between the solvent systems are evident at tetralin concentrations between 8–70%.

It is apparent that hydrogen gas is beneficial. However, at a given tetralin level, methyl naphthalene based solvents with hydrogen show only a modest improvement over pyrene based solvents without hydrogen. In marked contrast pyrene based solvents respond dramatically to hydrogen pressure and at only 30% tetralin, the blended solvent is almost as effective as 100% tetralin.

The same general effects are observed for the conversion of Monterey coal, FIG. 3. In this instance, the two lower curves are not parallel. However, the conversion in 2-methyl naphthalene shows approximately proportional dependence on tetralin concentration whereas in the pyrene-tetralin-$H_2$ system there is again a major increase in conversion with as little as 15% tetralin.

The presence of molecular hydrogen is known to increase coal conversion in solvents which have low donor capacity. The data presented here confirm these findings and also demonstrate that the effect of hydrogen gas is dependent upon the chemical structure of the other compounds present. In particular, the combination of a polycondensed aromatic (pyrene) with a donor in the presence of hydrogen behaves synergistically with respect to coal conversion.

Figure 4:
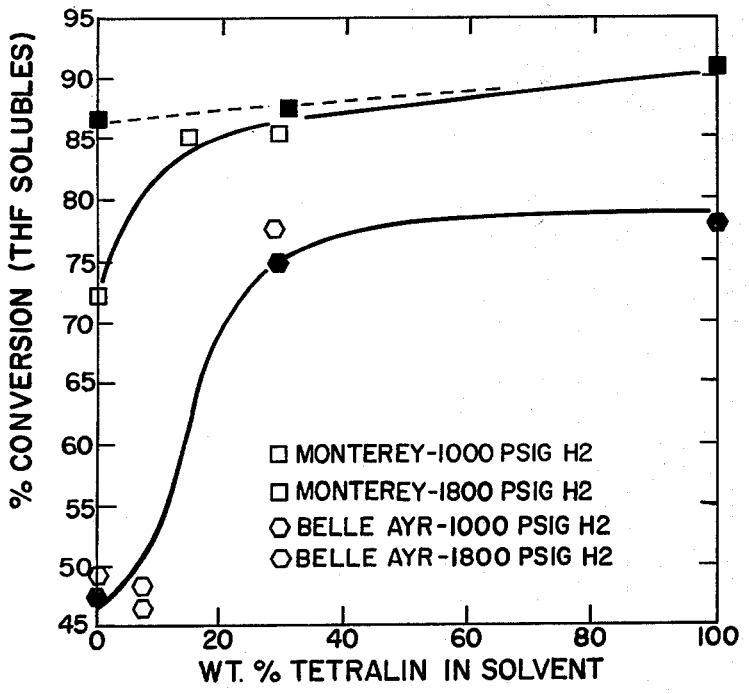
FIG. 4 shows the effect of hydrogen pressure on coal conversion using model solvents consisting of pyrene-tetralin mixtures.

The influence of hydrogen pressure on the conversion of the two coals is shown as a function of donor concentration in FIG. 4. The pressures examined were 1000 and 1800 psig.

There was no apparent effect due to hydrogen pressure, over this range, for the conversion of Belle Ayr coal. However, with Monterey coal, the effect of increasing pressure was to increase the conversion in pure pyrene and in pyrene-tetralin mixtures to that obtained in pure tetralin. Thus, from the standpoint of maximizing conversion of Monterey coal under these conditions, there is little benefit to be derived from the addition of tetralin. This is not to state that the quality of the liquefied products is independent of donor concentration.

The different responses of the two coals studied may be partly attributable to differences in their respective mineral matter compositions. It has been reported that the hydrogenation of pyrene is related to the coal pyritic iron content which is much higher for the Monterey coal.

It is commonly known that the extent of coal conversion is related to the hydrogen consumed in the process. Under given reaction conditions, the quantity of hydrogen required is independent of solvent composition. At any given time, the majority of hydrogen is supplied by the most labile source.

Figure 5:
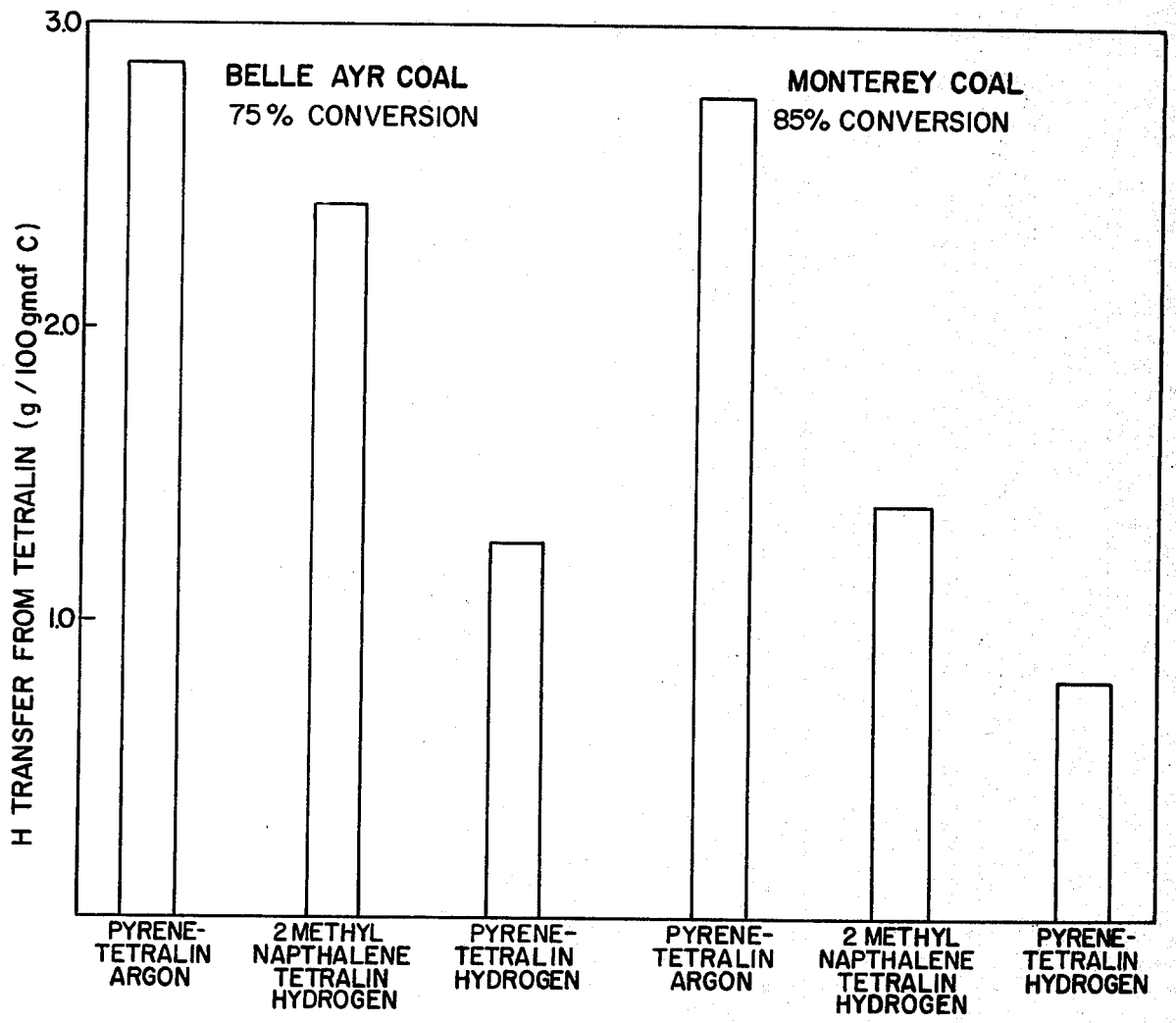
FIG. 5 describes the effect of solvent composition and gas atmosphere on hydrogen transfer.

It would be assumed that in the systems described, tetralin would be the preferred hydrogen source. The amount of hydrogen made available by tetralin dehydrogenation has been calculated in each instance. The relative effect of the other solvent component and the gas atmosphere on hydrogen transfer from tetralin in shown in FIG. 5 for both coals at a selected level of conversion. It can be seen that the required donor capacity for coal conversion is dependent upon the nature of the coal and of the other solvent components present. The implication is that there is considerable potential for economy in donor consumption by judicious control of the solvent composition.

From previous work with pyrene alone, it seems probable that the reduced hydrogen transfer from tetralin is due to part of the hydrogen demand being met by the transfer of molecular hydrogen to the coal through the formation of dihydropyrene. Such a mechanism is not as readily available with 2-methyl naphtalene as it is more difficult to reduce with hydrogen. No evidence of the presence of 2-methyl tetralin in the reaction products was found when 2-methyl naphthalene was used as a solvent component.

Table II describes results obtained from further liquefaction runs using tetralin and pyrene as representative hydrogen donor and hydrogen transfer solvents, respectively, for the conversion of Belle Ayr and Monterey coals. Reaction in each case was carried out at 750° F. for 60 minutes with a solvent to coal ratio of 3:1. For comparable conversions of coal to soluble products, it was found that with solvents comprising tetralin-pyrene mixtures a lower fraction of the hydrogen consumption could be attributed to dehydrogenation of the hydroaromatic species.

TABLE II

| Coal | Wt % Tetralin in Pyrene-Tetralin Solvent | $H_2$ Pressure (psig) | Conversion % maf | $H_2$ from Tetralin g/100 mafc |
|---|---|---|---|---|
| Belle Ayr | 100 | 0 | 81.5 | 3.30 |
| Belle Ayr | 100 | 1800 | 77.9 | 2.59 |
| Belle Ayr | 28.4 | 1000 | 77.6 | 1.83 |
| Belle Ayr | 29.2 | 1800 | 74.8 | 1.14 |
| Monterey | 100 | 1000 | 90.7 | 1.50 |

TABLE II-continued

| Coal | Wt % Tetralin in Pyrene-Tetralin Solvent | $H_2$ Pressure (psig) | Conversion % maf | $H_2$ from Tetralin g/100 mafc |
|---|---|---|---|---|
| Monterey | 29.1 | 1000 | 85.4 | 0.74 |

Still further experiments were conducted to investigate the reactions between pyrene, tetralin and hydrogen gas in an attempt to elucidate reasons for the observed synergism between the solvent components. The results are summarized in Table III and show the extent of pyrene hydrogenation under the different conditions studied.

TABLE III

Thermal Reactions of Pyrene, Tetralin and Hydrogen

| Solvent | Gas | Time (mins) | Temp (°C.) | Pressure (psig) | % Pyrene Conversion to Dihydropyrene |
|---|---|---|---|---|---|
| Pyrene | $H_2$ | 60 | 400 | 1000 | 0.6 |
| 92% Pyrene/ 8% Iron Pyrites | $H_2$ | 60 | 400 | 1000 | 2.5 |
| 50% Pyrene/ Tetralin | Ar | 60 | 400 | 1000 | 5.7 |
| 50% Pyrene/ Tetralin | $H_2$ | 60 | 400 | 1000 | 8.6 |

It can be seen that pyrene was thermally hydrogenated by reaction with hydrogen gas and under these conditions, its conversion to dihydropyrene was low (0.6%). The extent of hydrogenation was increased by the addition of iron pyrites. These findings are consistent with previous results relating conversion in pyrene to coal mineral matter catalysis.

In an inert atmosphere, in the presence of tetralin, 5.7% of the pyrene was hydrogenated. This result is particularly significant as it establishes that tetralin can transfer hydrogen to pyrene producing a substantial concentration of a more active donor.

The same experiment conducted under molecular hydrogen resulted in a still greater degree of pyrene hydrogenation which was higher than would be predicted from a purely additive effect.

The foregoing results suggest that there may be several different mechanisms to effect H-transfer in systems which contain donors and polyaromatic compounds. Without wishing to be bound by any theory of operability, some possible alternatives are discussed below in an attempt to rationalize the data.

Neglecting direct interaction of hydrogen gas with coal derived free radicals, there appear to be four possible routes for H-transfer:

(1) Tetralin + R· → Naphthalene + R-H (2) Tetralin + Pyrene → Naphthalene + Dihydropyrene (3) Pyrene + $H_2$ → Dihydropyrene (4) Dihydropyrene + R· → Pyrene + R-H Reaction (1) is the conventially regarded process of hydrogen transfer from a donor. Reaction (2), it has been shown, can take place thermally and is promoted by molecular hydrogen. Reaction (3) can occur thermally and is catalyzed by coal mineral matter. Reaction (4) is parallel to reaction (1) and presumably proceeds at a faster rate.

In pure tetralin, reaction (1) prevails and in pure pyrene, reactions (3) and (4) take place. In pyrene-tetralin mixtures under hydrogen, all four reactions are possible and on this basis an explanation for the observed synergism in conversion and for the reduction in hydrogen transferred from tetralin is proposed.

The effect of reactions (2) and (3) is to generate dihydropyrene more quickly than if (3) alone were possible. The net result produces, in reasonable concentration, a more effective donor than tetralin and at a faster rate than if pyrene alone were present. This could account for the unexpected increase in conversion in a mixture of these compounds. In addition, some of the net hydrogen demand will be met via reaction (3) which will reduce the amount of hydrogen which otherwise would be predominantly supplied by the tetralin.

What is claimed:

1. A process for the liquefaction of solid carbonaceous material which comprises:

(a) forming a slurry of the solid carbonaceous material in a recycle liquefaction solvent;

(b) heating said slurry in the presence of hydrogen at a temperature and pressure sufficient to obtain a conversion of said solid carbonaceous material to at least 60% of soluble product;

(c) distilling the converted mixture of solid carbonaceous material and recycle solvent to recover a light fraction comprising gases and light liquids boiling below 250° to 400° F., a middle distillate fraction boiling below 600° to 700° F. and a heavy bottoms fraction;

(d) hydrotreating at least a portion of the middle distillate fraction and recovering recycle hydrogen donor solvent;

(e) extracting the heavy bottoms fraction with naphtha containing from about 10 to 50 wt.% aromatics;

(f) separating from said naphtha the components soluble therein as a recycle hydrogen transfer solvent; and (g) combining said recycle hydrogen donor solvent and said recycle hydrogen transfer solvent to form said recycle solvent recited in step (a).

2. The process of claim 1 wherein said recycle solvent contains from about 5 to 70 wt.% of said recycle hydrogen donor solvent.

3. The process of claim 1 wherein said converted mixtures of solid carbonaceous material is distilled at substantially atmospheric pressure.

4. In a process for the liquefaction of solid carbonaceous material wherein a slurry of solid carbonaceous material in a recycle liquefaction solvent is heated in the presence of hydrogen under liquefaction conditions sufficient to obtain a conversion of solid carbonaceous material to at least 60% of soluble product in the resulting digested mixture. The improvement which comprises providing a recycle solvent containing two components:

(a) a hydrogen donor solvent component is provided by hydrotreating a fraction of said digested mixture having an initial boiling point of about 250° to 400° F. and a final boiling point of about 600° to 700° F., and (b) a hydrogen transfer solvent component which transfer component is provided by extracting a heavy fraction of said digested mixture boiling above about 600° to 700° F. with a naphtha extraction solvent containing from about 10 to 50 wt.% aromatics and recovering the naphtha-soluble components of said heavy fraction.

5. The method of claim 4 wherein said recycle solvent contains from about 5 to 70 wt.% of the hydrogen donor solvent component.

* * * * *